US007912412B2

(12) United States Patent
Fujita et al.

(10) Patent No.: US 7,912,412 B2
(45) Date of Patent: Mar. 22, 2011

(54) TRANSFER-FIXING DEVICE, IMAGE FORMING APPARATUS INCLUDING THE TRANSFER-FIXING DEVICE, AND TRANSFER-FIXING METHOD

(75) Inventors: Takashi Fujita, Yokohama (JP); Shin Kayahara, Yokohama (JP); Takeshi Takemoto, Yamato (JP); Hiromitsu Takagaki, Yokohama (JP); Takashi Seto, Yokohama (JP); Hirohmi Tamura, Ebina (JP)

(73) Assignee: Ricoh Company, Ltd., Tokyo (JP)

( * ) Notice: Subject to any disclaimer, the term of this patent is extended or adjusted under 35 U.S.C. 154(b) by 274 days.

(21) Appl. No.: 12/073,501

(22) Filed: Mar. 6, 2008

(65) Prior Publication Data

US 2008/0219718 A1 Sep. 11, 2008

(30) Foreign Application Priority Data

Mar. 8, 2007 (JP) ..... 2007-057953

(51) Int. Cl.
*G03G 15/16* (2006.01)

(52) U.S. Cl. ..... 399/307

(58) Field of Classification Search ..... 399/307, 399/328, 335, 338

See application file for complete search history.

(56) References Cited

U.S. PATENT DOCUMENTS

| | | | | |
|---|---|---|---|---|
| 4,365,139 | A * | 12/1982 | Dannatt | 399/335 X |
| 5,568,240 | A * | 10/1996 | Ohtsuka | 399/335 |
| 6,175,713 | B1 * | 1/2001 | Uehara et al. | 399/307 |
| 6,785,501 | B2 * | 8/2004 | Hongawa et al. | 399/307 |
| 7,031,648 | B2 | 4/2006 | Takashi et al. | |
| 7,127,202 | B2 | 10/2006 | Fujita et al. | |
| 7,233,762 | B2 | 6/2007 | Kunii et al. | |
| 7,299,003 | B2 | 11/2007 | Kurotaka et al. | |
| 2004/0037595 | A1 | 2/2004 | Takashi et al. | |
| 2005/0025534 | A1 | 2/2005 | Fujita et al. | |
| 2005/0201783 | A1 | 9/2005 | Kurotaka et al. | |
| 2005/0207801 | A1 | 9/2005 | Kunii et al. | |
| 2006/0140689 | A1 * | 6/2006 | Echigo et al. | 399/328 |
| 2007/0012676 | A1 | 1/2007 | Koide et al. | |
| 2007/0065188 | A1 | 3/2007 | Takagaki et al. | |
| 2007/0071511 | A1 | 3/2007 | Suzuki et al. | |
| 2007/0212126 | A1 | 9/2007 | Seto et al. | |
| 2007/0212129 | A1 | 9/2007 | Takemoto et al. | |
| 2007/0218386 | A1 | 9/2007 | Suzuki et al. | |
| 2008/0008505 | A1 | 1/2008 | Seto et al. | |

FOREIGN PATENT DOCUMENTS

| | | |
|---|---|---|
| JP | 2002-099159 | 4/2002 |
| JP | 2003-316176 | 11/2003 |
| JP | 2004-145260 | 5/2004 |
| JP | 2005-037879 | 2/2005 |

* cited by examiner

*Primary Examiner* — Sandra L Brase
(74) *Attorney, Agent, or Firm* — Harness, Dickey & Pierce, P.L.C.

(57) ABSTRACT

A transfer-fixing device transfers and fixes a toner image onto a transfer-fixing surface of a recording medium, and includes a transfer-fixing member, a pressing member, a heating member, and a temperature equalization member. The transfer-fixing member carries the toner image. The pressing member pressingly contacts the transfer-fixing member to form a nip between the pressing member and the transfer-fixing member through which the recording medium passes. The heating member heats the transfer-fixing surface of the recording medium conveyed toward the nip so that the recording medium reaches the nip before a temperature of a back surface opposite the transfer-fixing surface of the recording medium increases. The temperature equalization member equalizes temperature distribution on a surface of the transfer-fixing member in a width direction of the transfer-fixing member perpendicular to a conveyance direction of the recording medium, after the surface of the transfer-fixing member passes the nip.

19 Claims, 4 Drawing Sheets

TRANSFER-FIXING DEVICE, IMAGE FORMING APPARATUS INCLUDING THE TRANSFER-FIXING DEVICE, AND TRANSFER-FIXING METHOD

PRIORITY STATEMENT

The present patent application claims priority from Japanese Patent Application No. 2007-057953 filed on Mar. 8, 2007 in the Japan Patent Office, the entire contents of which are hereby incorporated herein by reference.

BACKGROUND OF THE INVENTION

1. Field of the Invention

Example embodiments generally relate to a transfer-fixing device, an image forming apparatus including the transfer-fixing device, and a transfer-fixing method, for example, for simultaneously transferring and fixing a toner image onto a recording medium.

2. Description of the Related Art

A related-art image forming apparatus, such as a copier, a printer, a facsimile machine, or a multifunction printer having two or more of copying, printing, scanning, and facsimile functions, forms a toner image on a recording medium. For example, an electrostatic latent image formed on an image carrier is made visible with toner as a toner image. The toner image is then transferred from the image carrier onto an intermediate transfer member (e.g., an intermediate transfer belt). The toner image is further transferred from the intermediate transfer member onto a recording medium in a transfer process. A fixing device applies heat and pressure to the recording medium bearing the toner image to fix the toner image on the recording medium in a fixing process.

Such image forming apparatus, in which the transfer process and the fixing process are performed separately, may form a faulty image when the toner image is transferred onto a recording medium having a rough surface. For example, when the rough recording medium contacts the intermediate transfer member, the intermediate transfer member may not fully conform to irregularities in the rough surface of the recording medium and minute gaps may be formed between the intermediate transfer member and the recording medium. Accordingly, faulty electrical discharge may be generated in the minute gaps and the toner image carried by the intermediate transfer member may not be transferred onto the recording medium properly. As a result, a faulty image is formed on the recording medium.

To address this problem, one example of a related-art image forming apparatus includes a transfer-fixing device for performing the transfer process and the fixing process simultaneously in a transfer-fixing process. In the transfer-fixing device, a pressing member contacts a transfer-fixing member to form a nip at which the transfer process and the fixing process are performed simultaneously. While a recording medium passes through the nip, a toner image carried by the transfer-fixing member is transferred and fixed onto the recording medium. In other words, while the toner image is transferred from the transfer-fixing member onto the recording medium, heat is applied to the toner image to soften and melt toner particles forming the toner image. Accordingly, the toner particles are formed into a viscoelastic block. Even when the recording medium has a rough surface and the minute gaps are formed between the transfer-fixing member and the recording medium, the viscoelastic block of toner particles is transferred into the minute gaps. As a result, a high-quality toner image may be formed on the recording medium.

Further, in the image forming apparatus in which the transfer process and the fixing process are performed simultaneously, a conveyance path for conveying the recording medium to the nip formed between the transfer-fixing member and the pressing member may be flexibly designed, because the recording medium does not bear an unfixed toner image before the recording medium reaches the nip. By contrast, in an image forming apparatus in which the transfer process and the fixing process are performed separately, a toner image is transferred onto a recording medium in a transfer device and the toner image is fixed on the recording medium in a fixing device. In other words, the recording medium bears an unfixed toner image before the recording medium reaches a nip formed between a fixing member and a pressing member in the fixing device at which the fixing process is performed. Therefore, a conveyance path connecting the transfer device to the fixing device needs to be designed such that the unfixed toner image on the recording medium does not touch the conveyance path.

In the transfer-fixing device in which the transfer process and the fixing process are performed simultaneously, the transfer-fixing member bearing the toner image is heated to melt toner particles forming the toner image. Therefore, the transfer-fixing member may be thick to extend its life. In addition, when the transfer-fixing member is provided in a large, tandem-type image forming apparatus, the transfer-fixing member may have a large circumferential length, decreasing thermal efficiency of the transfer-fixing member. As a result, the transfer-fixing device may consume a great amount of energy.

Moreover, in order to mitigate thermal damage to an image forming device for forming a toner image to be carried by the transfer-fixing member, the transfer-fixing member is cooled after the transfer-fixing process. Thus, the transfer-fixing member is repeatedly heated and cooled. As a result, the transfer-fixing device may consume a great amount of energy for this reason as well.

SUMMARY

At least one embodiment may provide a transfer-fixing device that transfers and fixes a toner image onto a transfer-fixing surface of a recording medium, and includes a transfer-fixing member, a pressing member, a heating member, and a temperature equalization member. The transfer-fixing member carries the toner image. The pressing member pressingly contacts the transfer-fixing member to form a nip between the pressing member and the transfer-fixing member through which the recording medium passes. The heating member heats the transfer-fixing surface of the recording medium conveyed toward the nip so that the recording medium reaches the nip before a temperature of a back surface of the recording medium opposite the transfer-fixing surface of the recording medium increases. The temperature equalization member equalizes temperature distribution on a surface of the transfer-fixing member in a width direction of the transfer-fixing member perpendicular to a conveyance direction of the recording medium, after the surface of the transfer-fixing member passes the nip.

At least one embodiment may provide an image forming apparatus that includes a transfer-fixing device to transfer and fix a toner image onto a transfer-fixing surface of a recording medium. The transfer-fixing device includes a transfer-fixing member, a pressing member, a heating member, and a temperature equalization member. The transfer-fixing member carries the toner image. The pressing member pressingly contacts the transfer-fixing member to form a nip between the pressing member and the transfer-fixing member through which the recording medium passes. The heating member heats the transfer-fixing surface of the recording medium conveyed toward the nip so that the recording medium reaches the nip before a temperature of a back surface of the recording medium opposite the transfer-fixing surface of the recording medium increases. The temperature equalization member equalizes temperature distribution on a surface of the transfer-fixing member in a width direction of the transfer-fixing member perpendicular to a conveyance direction of the recording medium, after the surface of the transfer-fixing member passes the nip.

At least one embodiment may provide a transfer-fixing method that includes carrying a toner image with a transfer-fixing member, forming a nip between the transfer-fixing member and a pressing member, and heating a transfer-fixing surface of a recording medium conveyed toward the nip so that the recording medium reaches the nip before a temperature of a back surface of the recording medium opposite the transfer-fixing surface of the recording medium increases. The method further includes transferring and fixing the toner image carried by the transfer-fixing member onto the heated recording medium at the nip and equalizing temperature distribution on a surface of the transfer-fixing member in a width direction of the transfer-fixing member perpendicular to a conveyance direction of the recording medium, after the surface of the transfer-fixing member passes the nip.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
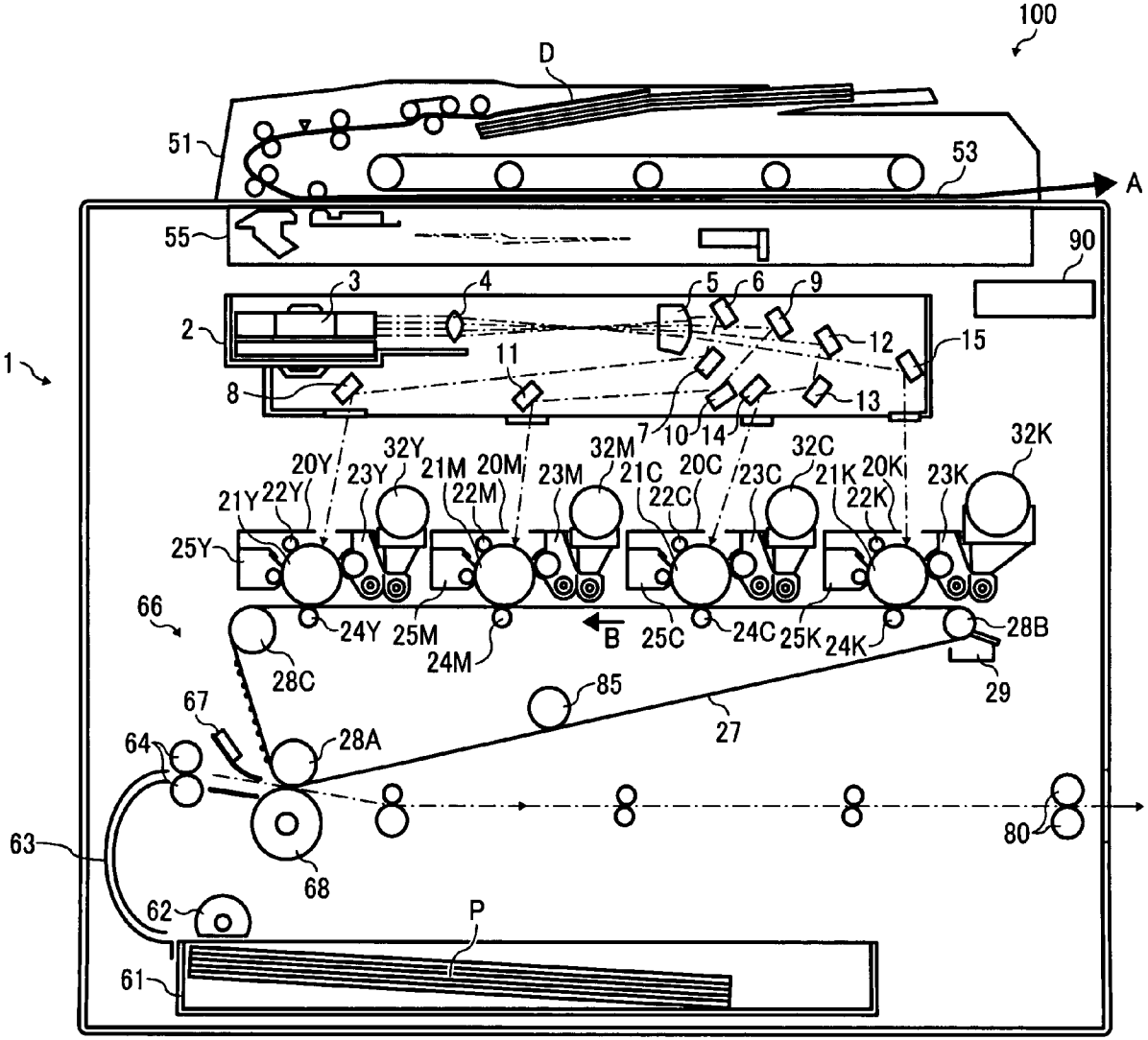
FIG. 1 is a sectional view of an image forming apparatus according to an example embodiment.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 100 according to an example embodiment is explained.

As illustrated in FIG. 1, the image forming apparatus 100 includes an original document feeder 51 and/or a body 1. The body 1 includes an original document reader 55, a writer 2, process cartridges 20Y, 20M, 20C, and 20K, toner suppliers 32Y, 32M, 32C, and 32K, a transfer-fixing device 66, a paper tray 61, a feed roller 62, a conveyance guide 63, a registration roller pair 64, an output roller pair 80, and/or a controller 90.

The original document reader 55 includes an exposure glass 53. The writer 2 includes a polygon mirror 3, lenses 4 and 5, and/or mirrors 6 to 15. The process cartridges 20Y, 20M, 20C, and 20K include photoconductors 21Y, 21M, 21C, and 21K, chargers 22Y, 22M, 22C, and 22K, development devices 23Y, 23M, 23C, and 23K, and/or cleaners 25Y, 25M, 25C, and 25K, respectively. The transfer-fixing device 66 includes a transfer-fixing belt 27, rollers 28A, 28B, and 28C, an equalization roller 85, transfer bias rollers 24Y, 24M, 24C, and 24K, a pressing roller 68, a heating device 67, and/or a belt cleaner 29.

The image forming apparatus 100 may be a copier, a facsimile machine, a printer, a multifunction printer having two or more of copying, printing, scanning, and facsimile functions, or the like. According to this non-limiting example embodiment, the image forming apparatus 100 functions as a color copier for forming a color image on a recording medium (e.g., a recording sheet and/or a transfer sheet).

The following describes a structure and operations of the image forming apparatus 100 for forming a color toner image on a recording medium. In the original document feeder 51, a feed roller (not shown) feeds an original document D placed on an original document tray (not shown) in a direction A onto the exposure glass 53 included in the original document reader 55. The original document reader 55 optically reads an image on the original document D placed on the exposure glass 53 to generate image data.

Specifically, in the original document reader 55, a lamp (not shown) moves and emits light onto the original document D placed on the exposure glass 53. The light reflected by the original document D enters a color sensor (not shown) via mirrors and a lens (not shown) to form an image in the color sensor. The color sensor reads the image into RGB (red, green, blue) image data and converts the RGB image data into electric image signals. An image processor (not shown) performs processing, such as color conversion processing, color correction processing, and space frequency correction processing, according to the electric image signals to generate yellow, magenta, cyan, and black image data. The yellow, magenta, cyan, and black image data is sent to the writer 2.

The writer 2 (e.g., an exposure portion) emits laser beams toward the process cartridges 20Y, 20M, 20C, and 20K according to the yellow, magenta, cyan, and black image data, respectively. For example, in the writer 2, a light source (not shown) emits laser beams according to the yellow, magenta, cyan, and black image data toward the polygon mirror 3. The polygon mirror 3 reflects the laser beams toward the lenses 4 and 5. The laser beams pass through the lenses 4 and 5 and travel on different optical paths, that is, optical paths corresponding to the yellow, magenta, cyan, and black image data in an exposure process.

In the process cartridges 20Y, 20M, 20C, and 20K, the photoconductors 21Y, 21M, 21C, and 21K, the chargers 22Y, 22M, 22C, and 22K, and the cleaners 25Y, 25M, 25C, and 25K are integrally provided, respectively. An image forming process for forming yellow, magenta, cyan, and black toner images on the photoconductors 21Y, 21M, 21C, and 21K is performed in the process cartridges 20Y, 20M, 20C, and 20K, respectively.

Each of the photoconductors 21Y, 21M, 21C, and 21K, serving as an image carrier, has a drum shape and rotates clockwise in FIG. 1. The chargers 22Y, 22M, 22C, and 22K uniformly charge surfaces of the photoconductors 21Y, 21M, 21C, and 21K at positions opposing the photoconductors 21Y, 21M, 21C, and 21K, respectively, in a charging process. Thus, a charging potential is formed on the photoconductors 21Y, 21M, 21C, and 21K. The charged surfaces of the photoconductors 21Y, 21M, 21C, and 21K reach positions at which the photoconductors 21Y, 21M, 21C, and 21K receive the laser beams emitted by the writer 2, respectively.

The mirrors 6 to 8 reflect a laser beam corresponding to the yellow image data toward the surface of the photoconductor 21Y included in the process cartridge 20Y provided at a first from the left in FIG. 1. The polygon mirror 3 rotating at a high speed scans the laser beam corresponding to the yellow image data in an axial direction (e.g., a main scanning direction) of the photoconductor 21Y. Thus, an electrostatic latent image corresponding to the yellow image data is formed on the photoconductor 21Y charged by the charger 22Y.

Similarly, the mirrors 9 to 11 reflect a laser beam corresponding to the magenta image data toward the surface of the photoconductor 21M included in the process cartridge 20M provided at a second from the left in FIG. 1. Thus, an electrostatic latent image corresponding to the magenta image data is formed on the photoconductor 21M charged by the charger 22M. The mirrors 12 to 14 reflect a laser beam corresponding to the cyan image data toward the surface of the photoconductor 21C included in the process cartridge 20C provided at a third from the left in FIG. 1. Thus, an electrostatic latent image corresponding to the cyan image data is formed on the photoconductor 21C charged by the charger 22C. The mirror 15 reflects a laser beam corresponding to the black image data toward the surface of the photoconductor 21K included in the process cartridge 20K provided at a fourth from the left in FIG. 1. Thus, an electrostatic latent image corresponding to the black image data is formed on the photoconductor 21K charged by the charger 22K.

The surfaces of the photoconductors 21Y, 21M, 21C, and 21K bearing the electrostatic latent images corresponding to the yellow, magenta, cyan, and black image data reach positions opposing the development devices 23Y, 23M, 23C, and 23K, respectively. The toner suppliers 32Y, 32M, 32C, and 32K supply yellow, magenta, cyan, and black toners to the development devices 23Y, 23M, 23C, and 23K, respectively. The development devices 23Y, 23M, 23C, and 23K supply the yellow, magenta, cyan, and black toners to the photoconductors 21Y, 21M, 21C, and 21K to visualize the electrostatic latent images formed on the photoconductors 21Y, 21M, 21C, and 21K with the supplied toners, respectively, in a development process. Thus, yellow, magenta, cyan, and black toner images are formed.

In the transfer-fixing device 66, the transfer-fixing belt 27, serving as a transfer-fixing member, is looped over and supported by a plurality of rollers, that is, the rollers 28A, 28B, and 28C, and the equalization roller 85. The equalization roller 85 serves as a temperature equalization member for equalizing temperature distribution on the transfer-fixing belt 27 in a width direction of the transfer-fixing belt 27. The transfer bias rollers 24Y, 24M, 24C, and 24K contact an inner circumferential surface of the transfer-fixing belt 27 and oppose the photoconductors 21Y, 21M, 21C, and 21K via the transfer-fixing belt 27, respectively. The transfer bias rollers 24Y, 24M, 24C, and 24K transfer the yellow, magenta, cyan, and black toner images formed on the photoconductors 21Y, 21M, 21C, and 21K, respectively, onto the transfer-fixing belt 27. For example, when the surfaces of the photoconductors 21Y, 21M, 21C, and 21K carrying the yellow, magenta, cyan, and black toner images reach opposing positions at which the photoconductors 21Y, 21M, 21C, and 21K oppose the transfer bias rollers 24Y, 24M, 24C, and 24K via the transfer-fixing belt 27, respectively, the yellow, magenta, cyan, and black toner images formed on the photoconductors 21Y, 21M, 21C, and 21K, respectively, are transferred and superimposed onto the transfer-fixing belt 27 in a first transfer process. Thus, a color toner image is formed on the transfer-fixing belt 27.

When the surfaces of the photoconductors 21Y, 21M, 21C, and 21K reach opposing positions at which the photoconductors 21Y, 21M, 21C, and 21K oppose the cleaners 25Y, 25M, 25C, and 25K, respectively, after the first transfer process, the cleaners 25Y, 25M, 25C, and 25K collect residual toner particles not transferred and remaining on the photoconductors 21Y, 21M, 21C, and 21K, respectively, in a cleaning process. When the surfaces of the photoconductors 21Y, 21M, 21C, and 21K pass dischargers (not shown), a cycle of image forming process performed on the photoconductors 21Y, 21M, 21C, and 21K is completed.

An outer circumferential surface of the transfer-fixing belt 27 carrying the color toner image rotates in a rotating direction B and reaches a nip formed between the transfer-fixing belt 27 and the pressing roller 68. At the nip, the pressing roller 68, serving as a pressing member, pressingly contacts the transfer-fixing belt 27. Unlike known transfer-fixing devices, the transfer-fixing device 66 according to this example embodiment does not include a device for directly heating the transfer-fixing belt 27. Even when the transfer-fixing device 66 includes such device, the device may generate a small amount of heat.

The paper tray 61 loads a recording medium P (e.g., a transfer sheet or a recording sheet). The recording medium P is conveyed from the paper tray 61 toward the nip formed between the transfer-fixing belt 27 and the pressing roller 68 via the feed roller 62, the conveyance guide 63, the registration roller pair 64, and the heating device 67. For example, the feed roller 62 feeds a recording medium P from the paper tray 61 toward the conveyance guide 63. The conveyance guide 63 guides the recording medium P toward the registration roller pair 64. The registration roller pair 64 feeds the recording medium P toward the nip formed between the transfer-fixing belt 27 and the pressing roller 68 at a time at which the color toner image formed on the transfer-fixing belt 27 is properly transferred onto the recording medium P. The heating device 67, serving as a heating member, heats a front surface (e.g., a transfer-fixing surface) of the recording medium P onto which the color toner image is to be transferred from the transfer-fixing belt 27.

At the nip formed between the transfer-fixing belt 27 and the pressing roller 68, the color toner image carried by the transfer-fixing belt 27 is transferred onto the transfer-fixing surface of the recording medium P and fixed on the recording medium P in a transfer-fixing process. For example, the heating device 67 heats the transfer-fixing surface of the recording medium P before the transfer-fixing process, that is, before the recording medium P reaches the nip formed between the transfer-fixing belt 27 and the pressing roller 68. At the nip, heat applied to the transfer-fixing surface of the recording medium P heats and melts the color toner image transferred on the recording medium P and pressure applied at the nip fixes the color toner image on the transfer-fixing surface of the recording medium P. Thus, the transfer-fixing device 66 transfers the color toner image onto the recording medium P and fixes the transferred color toner image on the recording medium P.

When the outer circumferential surface of the transfer-fixing belt 27 reaches a position at which the transfer-fixing belt 27 opposes the belt cleaner 29, the belt cleaner 29 collects residual toner particles adhered to the transfer-fixing belt 27. Thus, the belt cleaner 29 cleans the transfer-fixing belt 27 after the transfer-fixing process. Accordingly, a cycle of transfer-fixing process performed on the transfer-fixing belt 27 is completed.

The recording medium P bearing the fixed color toner image passes through an output conveyance path (not shown) and is output by the output roller pair 80 to an outside of the image forming apparatus 100. Accordingly, a cycle of image forming process is completed. The controller 90 controls the operations of the image forming apparatus 100.

The image forming apparatus 100 according to this example embodiment may preferably use toner appropriate for fixing at a low temperature. For example, a softening point (e.g., a one-half melting temperature) of toner may be about 100 degrees centigrade.

A binder resin contained in toner may include homopolymers of styrene and derivative of styrene, such as polyester, polystyrene, poly-p-chlorostyrene, and/or polyvinyl toluene, and/or styrene copolymers, such as a styrene-p-chlorostyrene copolymer, a styrene-propylene copolymer, a styrene-vinyl toluene copolymer, a styrene-vinyl naphthalene copolymer, a styrene-methyl acrylate copolymer, a styrene-ethyl acrylate copolymer, a styrene-butyl acrylate copolymer, a styrene-octyl acrylate copolymer, a styrene-methyl methacrylate copolymer, a styrene-ethyl methacrylate copolymer, a styrene-butyl methacrylate copolymer, a styrene-α-methyl chlormethacrylate copolymer, a styrene-acrylonitrile copolymer, a styrene-vinyl methyl ether copolymer, a styrene-vinyl ethyl ether copolymer, a styrene-vinyl methyl ketone copolymer, a styrene-butadiene copolymer, a styrene-isoprene copolymer, a styrene-acrylonitrile-indene copolymer, a styrene-maleic acid copolymer, and/or a styrene-maleate copolymer.

A binder resin contained in toner may also include a mixture of resins, such as polymethyl methacrylate, polybutyl methacrylate, polyvinyl chloride, polyvinyl acetate, polyethylene, polypropylene, polyurethane, polyamide, an epoxy resin, polyvinyl butyral, a polyacrylic resin, rosin, denatured rosin, a terpene resin, a phenol resin, an aliphatic or alicyclic hydrocarbon resin, an aromatic petroleum resin, chlorinated paraffin, and/or paraffin wax. Among the above, the resins containing a polyester resin may be preferably used to obtain a proper fixing property. Especially, a crystalline polyester resin softens and melts properly when contacting a recording medium P, providing a strengthened fixing property and an image forming property with an increased color reproduction. The polyester resin may be obtained by poly-condensation of alcohol and a carboxylic acid. The alcohol may include diols, such as polyethylene glycol, diethylene glycol, triethylene glycol, 1,2-propyrene glycol, 1,3-propyrene glycol, 1,4-butanediol, neo-pentyl glycol, and/or 1,4-butenediol, etherified bisphenols, such as 1,4-bis (hydroxymethyl)cyclohexane, bisphenol A, hydrogenated bisphenol A, polyoxyethylene bisphenol A, and/or polyoxypropylene bisphenol A, dihydric alcohol obtained by substituting the above with a saturated or non-saturated hydrocarbon radical having a carbon number of from 3 to 22, and/or other dihydric alcohol.

Carboxylic acids used for producing the polyester resin may include a maleic acid, a fumaric acid, a mesaconic acid, a citraconic acid, an itaconic acid, a glutaconic acid, a phthalic acid, an isophthalic acid, a terephthalic acid, a cyclohexane dicarboxylic acid, a succinic acid, an adipic acid, a sebacic acid, a malonic acid, a divalent organic acid monomer obtained by substituting the above with a saturated or non-saturated hydrocarbon radical having a carbon number of from 3 to 22, an acid anhydride of the above, a dimer of lower alkyl ester and a linolenic acid, and/or other divalent organic acid monomers.

To produce a polyester resin used as a binder resin, a polymer containing a component including not only a polymer containing the above difunctional monomer but also a multifunctional (e.g., trifunctional or more) monomer may be preferably used. The multifunctional monomers may include polyalcohol monomers (e.g., trivalent or more alcohol monomers), such as sorbitol, 1,2,3,6-hexane tetrol, 1,4-sorbitan, pentaerythritol, dipentaerythritol, tripentaerythritol, sucrose, 1,2,4-butanetriol, 1,2,5-pentanetriol, glycerol, 2-methyl propane triol, 2-methyl-1,2,4-butanetriol, trimethylolethane, trimethylolpropane, and/or 1,3,5-trihydroxy methyl benzene.

Polyvalent (e.g., trivalent or more) carboxylic acid monomers may include a 1,2,4-benzenetricarboxylic acid, a 1,2,5-benzentricarboxylic acid, a 1,2,4-cyclohexane tricarboxylic acid, a 2,5,7-naphthalene tricarboxylic acid, a 1,2,4-naphthalene tricarboxylic acid, a 1,2,4-butane tricarboxylic acid, a 1,2,5-hexane tricarboxylic acid, 1,3-dicarboxyl-2-methyl-2-methylenecarboxypropane, tetra(methylenecarboxyl)methane, a 1,2,7,8-octane tetracarboxylic acid, an enpol trimer acid, and/or an acid anhydride of the above.

Toner used in the image forming apparatus 100 according to this example embodiment may include a releasing agent to cause toner particles to be easily released from the surface of the transfer-fixing belt 27 in the transfer-fixing process. The toner used in the image forming apparatus 100 may include known releasing agents, preferably, free fatty-acid carnauba wax, montan wax, oxidized rice wax, ester wax, and/or a combination of two or more of the above waxes. Preferably, the carnauba wax may be microcrystalline and may have an acid number of 5 mgKOH/g or smaller and a particle size of about 1 μm or smaller when the carnauba wax is dispersed in a toner binder.

The montan wax may be generally refined from mineral. Like the carnauba wax, the montan wax may preferably be microcrystalline and have an acid number of from 5 mgKOH/g to 14 mgKOH/g. The oxidized rice wax may be obtained by oxidizing rice bran in the air and may preferably have an acid number of from 10 mgKOH/g to 30 mgKOH/g. When the waxes have an acid number smaller than the above-described ranges, a temperature of low temperature fixing may increase, providing improper low temperature fixing. When the waxes have an acid number greater than the above-described ranges, a cold offset temperature may increase, providing improper low temperature fixing. Wax in a range of from about 1 to about 15 parts by weight, preferably from about 3 to about 10 parts by weight, may be preferably added to a binder resin of about 100 parts by weight. When an amount of wax is smaller than about 1 part by weight, the toner may provide a decreased releasing property, and thereby may not provide a desired effect. When an amount of wax is greater than about 15 parts by weight, toner particles may adhere to carriers.

An additive may be added to improve fluidity of the toner. The additive may include silica, titanium oxide, and/or alumina. Further, fatty acid metal salts and/or polyvinylidene fluoride may be added, as needed.

Figure 2:
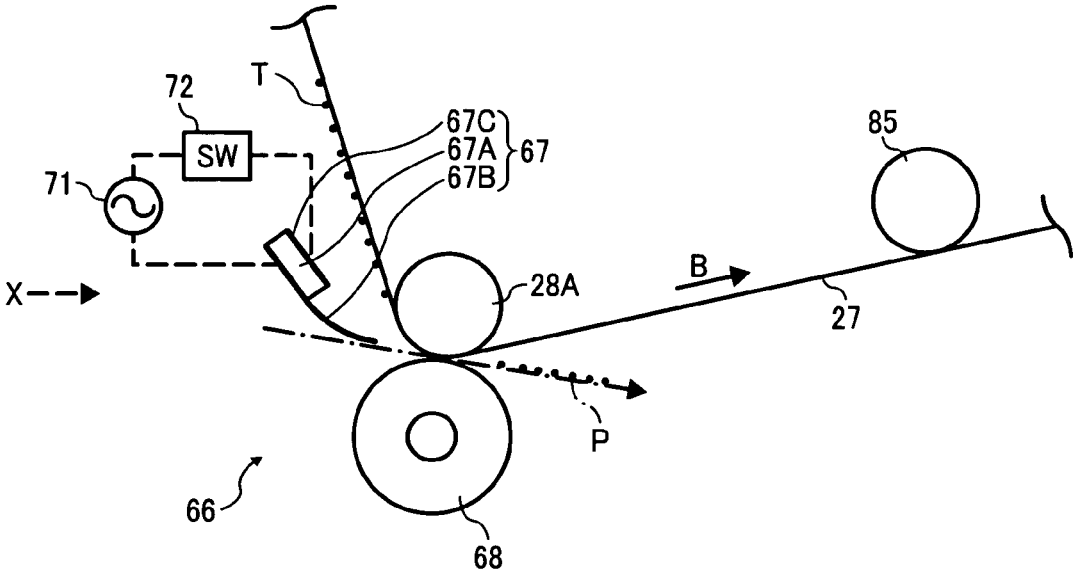
FIG. 2 is a partially enlarged sectional view (according to an example embodiment) of a transfer-fixing device included in the image forming apparatus shown in FIG. 1.
Figure 3:
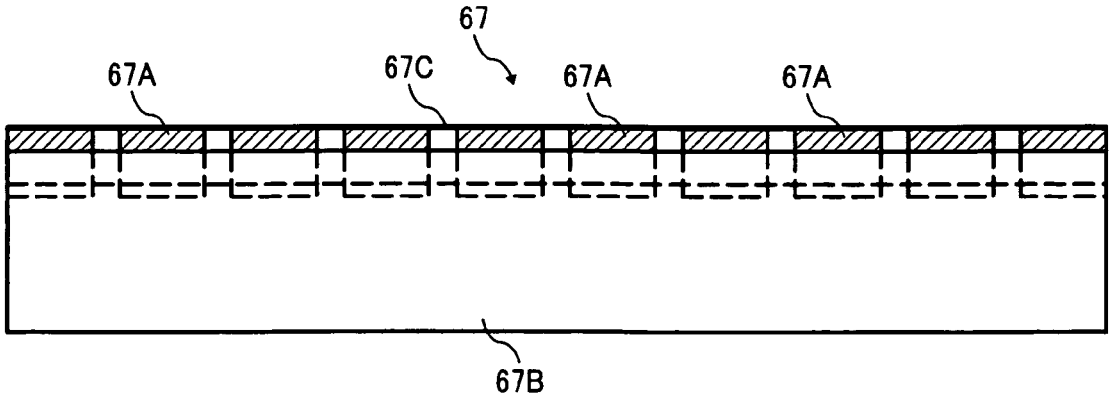
FIG. 3 is an illustration (according to an example embodiment) of a heating device included in the transfer-fixing device shown in FIG. 2 seen in a direction X of FIG. 2.

Referring to FIGS. 2 and 3, the following describes the transfer-fixing device 66. FIG. 2 is a partially enlarged sectional view of the transfer-fixing device 66. FIG. 3 is an illustration of the heating device 67 included in the transfer-fixing device 66 seen in a direction X of FIG. 2. As illustrated in FIG. 2, the transfer-fixing device 66 further includes an AC (alternating-current) power supply 71 and/or a switch 72. The heating device 67 includes a heating body 67A, a heat transmission plate 67B, and/or an electrode 67C.

As illustrated in FIG. 2, the transfer-fixing belt 27 is formed in an endless belt shape having a multilayer structure in which an elastic layer (not shown) is formed on a base layer (not shown) and a releasing layer (not shown) is formed on the elastic layer. The base layer includes a polyimide resin and has a thickness of about 40 μm. The elastic layer includes a rubber material and has a thickness of about 60 μm to conform to irregularities in a surface of a recording medium P. The releasing layer includes a fluorocarbon resin and has a thickness of about 6 μm to release toner particles from the surface of the transfer-fixing belt 27.

The pressing roller 68 rotates clockwise in FIG. 2 and includes a core (not shown) and a surface layer (not shown). The core includes aluminum and has a cylindrical shape. The surface layer is formed on the core and may serve as a releasing layer. A pressing mechanism (not shown) presses the pressing roller 68 toward the roller 28A via the transfer-fixing belt 27. Thus, a desired nip may be formed between the pressing roller 68 and the transfer-fixing belt 27. The surface layer of the pressing roller 68 may include PTFE (polytetrafluoroethylene), PFA (tetrafluoroethylene-perfluoroalkyl vinyl ether copolymer), and FEP (tetrafluoroethylene-hexafluoropropylene copolymer).

The heating device 67 is provided near and upstream from the nip formed between the pressing roller 68 and the transfer-fixing belt 27 in a conveyance direction of the recording medium P. The heating body 67A (e.g., a heater) is sandwiched between the heat transmission plate 67B and the electrode 67C. According to this example embodiment, the heating body 67A includes a resistance heat generator of which resistance sharply increases at a reference Curie point. For example, a positive character thermistor including a barium titanate semiconductor ceramic element is used as the heating body 67A. According to this example embodiment, ten heating bodies 67A (e.g., positive character thermistors) are arranged in a width direction of the heating device 67, that is, the width direction of the transfer-fixing belt 27 (e.g., a direction perpendicular to the conveyance direction of the recording medium P), as illustrated in FIG. 3.

The heat transmission plate 67B, serving as a heat transmission member, includes stainless steel and has a thickness of about 0.2 mm. A fore-end of the heat transmission plate 67B contacts the transfer-fixing surface (e.g., the front surface) of the recording medium P conveyed toward the nip formed between the pressing roller 68 and the transfer-fixing belt 27. Namely, the heat transmission plate 67B transmits heat generated by the heating body 67A to the transfer-fixing surface of the recording medium P. The AC power supply 71 is connected to the heat transmission plate 67B, and thereby the heat transmission plate 67B may also function as another electrode.

The AC power supply 71 is connected to the heat transmission plate 67B and the electrode 67C sandwiching the heating body 67A. When the switch 72 is turned on, an alternating-current voltage of about 100 volts is applied to both ends of the heating body 67A. Accordingly, an electric current flows in the heating body 67A and the heating body 67A generates heat. The heat generated by the heating body 67A is transmitted to the transfer-fixing surface of the recording medium P via the heat transmission plate 67B.

The heating body 67A may preferably have a Curie point lower than an ignition point of the recording medium P. Thus, a self temperature control function of the heating body 67A may reduce or prevent increase in temperature of the heating body 67A over the ignition point of the recording medium P.

For example, according to this example embodiment, the heating body 67A has a Curie point of about 200 degrees centigrade. Therefore, when a temperature of the heating body 67A exceeds about 200 degrees centigrade, a resistance between the electrode 67C and the heat transmission plate 67B sharply increases to reduce the electric current flowing in the heating body 67A. For example, when the temperature of the heating body 67A is about 210 degrees centigrade, the electric current flowing in the heating body 67A is reduced by one-half. When the temperature of the heating body 67A is about 220 degrees centigrade, the electric current flowing in the heating body 67A is reduced by one-quarter.

When about 1,200 watts of electric power is applied to the heating body 67A, the temperature of the heating body 67A increases to from about 190 to about 200 degrees centigrade in about 6 seconds. The self temperature control function of the heating body 67A prevents the temperature of the heating body 67A from exceeding about 210 degrees centigrade. As illustrated in FIG. 3, a plurality of heating bodies 67A is arranged in the width direction of the heating device 67, that is, the width direction of the transfer-fixing belt 27 (e.g., the direction perpendicular to the conveyance direction of the recording medium P) according to this example embodiment. Thus, each of the plurality of heating bodies 67A performs self temperature control to suppress variation in temperature of the heating device 67 in the width direction of the heating device 67 within about 10 degrees centigrade.

As illustrated in FIG. 2, the heating device 67 heats the transfer-fixing surface (e.g., the front surface) of the recording medium P before the transfer-fixing process. In other words, the recording medium P reaches the nip formed between the pressing roller 68 and the transfer-fixing belt 27 before a temperature of a back surface (e.g., a surface of the recording medium P opposite the transfer-fixing surface) of the recording medium P increases, that is, before heat is transmitted from the transfer-fixing surface to the back surface of the recording medium P.

When the recording medium P has a thickness of about 50 μm or greater, the recording medium P reaches the nip formed between the pressing roller 68 and the transfer-fixing belt 27 within about 50 milliseconds after the recording medium P passes the heating device 67, that is, a contact position at which the recording medium P contacts the heat transmission plate 67B. Namely, the recording medium P reaches the nip within about 50 milliseconds after the heating device 67 finishes heating the transfer-fixing surface of the recording medium P. A distance between the heating device 67 (e.g., the heat transmission plate 67B) and the nip, a conveyance speed (e.g., a process linear speed) of the recording medium P, and/or the like may be adjusted to cause the recording medium P to reach the nip within about 50 milliseconds.

According to this example embodiment, the recording medium P contacts the heating device 67 (e.g., the heat transmission plate 67B) for from about 10 milliseconds to about 20 milliseconds. The recording medium P reaches the nip formed between the pressing roller 68 and the transfer-fixing belt 27 in from about 2 milliseconds to about 5 milliseconds after the recording medium P contacts the heating device 67. Thus, the transfer-fixing device 66 may form an output image (e.g., a fixed toner image) providing a proper fixing property and color reproduction without a mechanism for directly heating the transfer-fixing belt 27.

The heating device 67 heats the transfer-fixing surface of the recording medium P up to a temperature higher than a temperature of the surface of the transfer-fixing belt 27. When a toner image T carried by the transfer-fixing belt 27 reaches the nip formed between the pressing roller 68 and the transfer-fixing belt 27, the toner image T receives heat from the recording medium P and toner particles forming the toner image T are heated and melted.

In a color image forming apparatus in which a transfer-fixing belt is directly heated, in order to form an output image having a proper gloss, an amount of heat increased by half compared to a monochrome image forming apparatus is applied to the transfer-fixing belt to prevent a recording medium from drawing heat from the transfer-fixing belt and thereby decreasing a temperature of the transfer-fixing belt. Accordingly, the recording medium is excessively heated and toner particles are excessively adhered to the recording medium.

However, according to this example embodiment, the heating device 67 heats the transfer-fixing surface of the recording medium P and therefore a temperature for putting a gloss to an output image may be separately set. Thus, a low fixing temperature may be applied to the transfer-fixing belt 27. Further, the recording medium P is not excessively heated and toner particles forming the toner image T are not excessively adhered to the recording medium P, because the recording medium P is heated before the transfer-fixing process.

Namely, the transfer-fixing device 66 according to this example embodiment may provide fixing at a low temperature and may shorten a warm-up time period, resulting in energy saving. Heat transmission to the transfer-fixing belt 27 may be suppressed, improving durability of the transfer-fixing belt 27. The transfer-fixing belt 27 may be heated up to a decreased temperature, preventing or reducing thermal degradation of the transfer-fixing belt 27.

As described above, the transfer-fixing device 66 suppresses heating of the transfer-fixing belt 27 but supplies heat needed for heating and melting toner particles forming a toner image on a recording medium P by effectively heating the recording medium P before the recording medium P is conveyed to the nip formed between the pressing roller 68 and the transfer-fixing belt 27. However, the transfer-fixing belt 27 may receive a substantial amount of heat non-uniformly distributed from the heated recording medium P and thereby the temperature of the transfer-fixing belt 27 may vary in the width direction of the transfer-fixing belt 27 (e.g., the direction perpendicular to the conveyance direction of the recording medium P), resulting in formation of a faulty image due to the variation in fixing temperature and toner offset. To address this problem, the transfer-fixing device 66 includes the equalization roller 85 serving as a temperature equalization member for equalizing temperature distribution on the surface of the transfer-fixing belt 27 in the width direction of the transfer-fixing belt 27 after the surface of the transfer-fixing belt 27 passes through the nip formed between the pressing roller 68 and the transfer-fixing belt 27.

The equalization roller 85 is provided at a position downstream from the nip formed between the pressing roller 68 and the transfer-fixing belt 27 in the rotating direction B of the transfer-fixing belt 27. The transfer-fixing belt 27 is looped over and supported by the equalization roller 85 and the three rollers 28A, 28B, and 28C (depicted in FIG. 1). The equalization roller 85 includes a heat pipe in which heat is effectively convected to equalize temperature distribution on the surface of the transfer-fixing belt 27 in the width direction of the transfer-fixing belt 27. Thus, even when the heating device 67 heats the recording medium P before the recording medium P reaches the nip formed between the pressing roller 68 and the transfer-fixing belt 27 by suppressing heating of the transfer-fixing belt 27, faulty fixing, such as variation in fixing temperature and toner offset, may not occur.

According to this example embodiment, the equalization roller 85 is formed of a heat pipe. Alternatively, the equalization roller 85 may be formed of a material having an increased thermal conductivity, such as graphite, while providing effects similar to the effects provided by the equalization roller 85 formed of the heat pipe.

According to this example embodiment, the transfer-fixing device 66 includes the equalization roller 85 in addition to the three rollers 28A, 28B, and 28C. Alternatively, one of the three rollers 28A, 28B, and 28C, that is, the roller 28B provided downstream from the nip formed between the pressing roller 68 and the transfer-fixing belt 27 in the rotating direction B of the transfer-fixing belt 27 may be used as an equalization roller (e.g., a heat pipe).

As described above, according to this example embodiment, the transfer-fixing device 66 includes the heating device 67 effectively heating a transfer-fixing surface of a recording medium P before the recording medium P is conveyed to the nip formed between the transfer-fixing belt 27, serving as a transfer-fixing member, and the pressing roller 68, serving as a pressing member. The transfer-fixing device 66 further includes the equalization roller 85, serving as a temperature equalization member for equalizing temperature distribution on the transfer-fixing belt 27 in the width direction of the transfer-fixing belt 27 after the transfer-fixing process. Thus, the transfer-fixing device 66 may reduce energy consumption and may reduce or prevent formation of a faulty image caused by improper fixing.

According to this example embodiment, the heating body 67A includes a resistance heat generator (e.g., a positive character thermistor). Alternatively, the heating body 67A may include a metal which generates heat by electromagnetic induction and has a magnetic permeability decreased at a reference Curie point. The heating body 67A including the metal may also provide effects similar to the effects provided by the heating body 67A including the resistance heat generator.

For example, the heating device 67 includes a plate spring member and/or an induction coil opposing the plate spring member. The plate spring member includes a magnetic shunt alloy, such as nickel and iron, and has a thickness of about 0.3 mm. Like the heat transmission plate 67B, a fore-end of the plate spring member contacts a recording medium P conveyed toward the nip formed between the transfer-fixing belt 27 and the pressing roller 68. When a high-frequency voltage of about 20 kHz is applied to the induction coil, the plate spring member is heated by electromagnetic induction and transmits heat to the transfer-fixing surface of the recording medium P. The plate spring member includes a nickel component occupying about 40 percent in the magnetic shunt alloy. When a temperature of the plate spring member reaches a Curie point of about 200 degrees centigrade, a magnetic permeability of the plate spring member sharply decreases and the plate spring member is not heated by electromagnetic induction. For example, the heating body 67A is heated up to from about 190 to about 200 degrees centigrade in about 3 seconds by electric power of about 1,200 watts and a self temperature control function of the heating body 67A prevents the heating body 67A from being heated up to about 210 degrees centigrade or higher.

Figure 4:
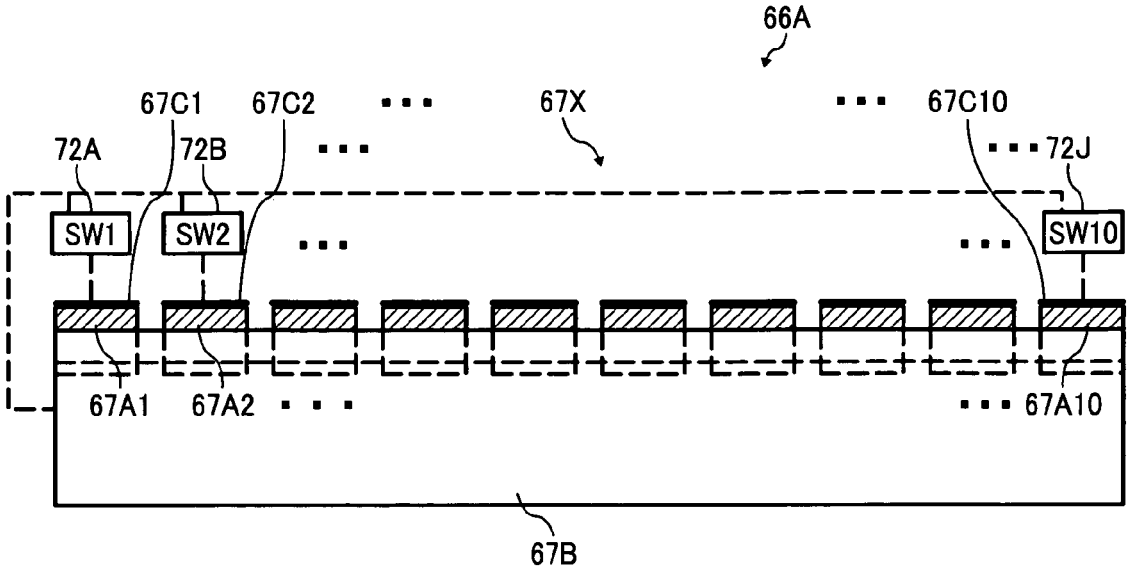
FIG. 4 is an illustration of a heating device according to another example embodiment.

Referring to FIG. 4, the following describes a transfer-fixing device 66A according to another example embodiment. The transfer-fixing device 66A includes a heating device 67× and/or switches 72A, 72B, 72C, 72D, 72E, 72F, 72G, 72H, 72I, and 72J. The heating device 67X includes heating bodies 67A1, 67A2, 67A3, 67A4, 67A5, 67A6, 67A7, 67A8, 67A9, and 67A10, the heat transmission plate 67B, and/or electrodes 67C1, 67C2, 67C3, 67C4, 67C5, 67C6, 67C7, 67C8, 67C9, and 67C10. The other elements of the transfer-fixing device 66A are common to the transfer-fixing device 66 depicted in FIG. 2.

FIG. 4 illustrates the heating device 67X in a width direction (e.g., a direction perpendicular to a conveyance direction of a recording medium P). In the transfer-fixing device 66A, the heating device 67X heats an image area, in which a toner image is formed, on a transfer-fixing surface of a recording medium P and does not heat a non-image area in which a toner image is not formed.

The ten heating bodies 67A1 to 67A10 and the ten electrodes 67C1 to 67C10 are arranged in the width direction of the heating device 67X. The switches 72A to 72J are connected to the heating bodies 67A1 to 67A10 and the electrodes 67C1 to 67C10, respectively, and each of the switches 72A to 72J is switchable independently.

The controller 90 (depicted in FIG. 1) controls the transfer-fixing device 66A according to image data sent to the controller 90 such that the transfer-fixing device 66A heats the image area but does not heat the non-image area on the transfer-fixing surface of the recording medium P. For example, the switches 72A to 72J selectively turn on the heating bodies 67A1 to 67A10 corresponding to the image area on the transfer-fixing surface of the recording medium P to heat the corresponding heating bodies 67A1 to 67A10. The switches 72A to 72J selectively turn off the heating bodies 67A1 to 67A10 corresponding to the non-image area on the transfer-fixing surface of the recording medium P so as not to heat the corresponding heating bodies 67A1 to 67A10.

The transfer-fixing device 66A having the above-described structure and configuration may prevent the heating device 67X from wastefully consuming electric power. Even when toner particles are adhered to a non-image area on the transfer-fixing belt 27 (depicted in FIG. 2), the toner particles may not be transferred and fixed onto the recording medium P at the nip formed between the transfer-fixing belt 27 and the pressing roller 68 (depicted in FIG. 2).

Variation in temperature on the surface of the transfer-fixing belt 27 included in the transfer-fixing device 66A in the width direction of the transfer-fixing belt 27 was measured by a thermography before and after the surface of the transfer-fixing belt 27 passes the equalization roller 85. The temperature of the surface of the transfer-fixing belt 27 varied in the width direction of the transfer-fixing belt 27 in a range of from about 30 to about 40 degrees centigrade before the surface of the transfer-fixing belt 27 passed the equalization roller 85. However, the temperature of the surface of the transfer-fixing belt 27 varied in the width direction of the transfer-fixing belt 27 within about 10 degrees centigrade after the surface of the transfer-fixing belt 27 passed the equalization roller 85. Even when a plurality of recording mediums P is continuously fed to the transfer-fixing belt 27, the transfer-fixing device 66A may not form a faulty image having uneven gloss or a faulty image caused by improper fixing and thereby may form a high-quality image stably.

As illustrated in FIG. 4, according to this example embodiment, like the transfer-fixing device 66 (depicted in FIG. 2), the transfer-fixing device 66A includes the heating device 67X effectively heating a transfer-fixing surface of a recording medium P before the recording medium P is conveyed to the nip formed between the transfer-fixing belt 27 and the pressing roller 68 (depicted in FIG. 2). The transfer-fixing device 66A further includes the equalization roller 85 (depicted in FIG. 2) for equalizing temperature distribution on the transfer-fixing belt 27 in the width direction of the transfer-fixing belt 27 after the transfer-fixing process. Thus, the transfer-fixing device 66A may reduce energy consumption and may reduce or prevent formation of a faulty image caused by improper fixing.

Figure 5:
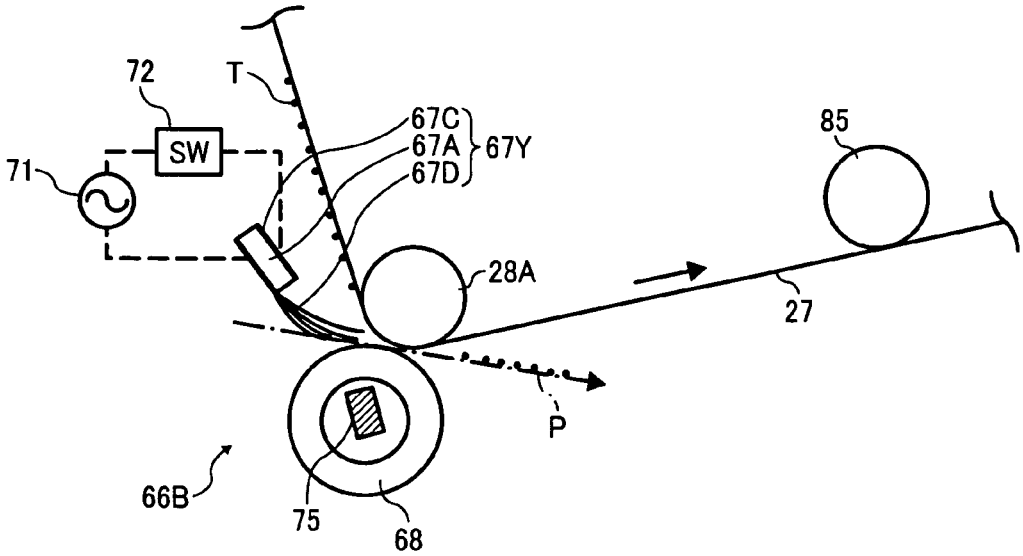
FIG. 5 is a partially enlarged sectional view of a transfer-fixing device according to yet another example embodiment.

Referring to FIG. 5, the following describes a transfer-fixing device 66B according to yet another example embodiment. FIG. 5 is a partially enlarged sectional view of the transfer-fixing device 66B. The transfer-fixing device 66B includes a magnet 75 and/or a heating device 67Y. The heating device 67Y includes the heating body 67A, the electrode 67C, and/or a brush member 67D. The other elements of the transfer-fixing device 66B are common to the transfer-fixing device 66 depicted in FIG. 2.

The brush member 67D has magnetism and contacts a transfer-fixing surface of a recording medium P to transmit heat to the recording medium P. Namely, the transfer-fixing device 66B includes the brush member 67D, serving as a heat transmission member, instead of the heat transmission plate 67B depicted in FIG. 2. The magnet 75, serving as a magnetic force generator, is provided inside the pressing roller 68 and opposes the brush member 67D. The magnet 75 generates a magnetic force for attracting the brush member 67D to the recording medium P. Thus, the brush member 67D stably contacts the recording medium P with time. Accordingly, bristles of the brush member 67D may not be curled or bent due to repeated contacts to the recording medium P, reducing or preventing improper heating of the recording medium P caused by improper contact of the brush member 67D to the recording medium P.

For example, the brush member 67D may be a bundle of fibers formed of SUS 304 and having an outer diameter of about 40 μm. Generally, SUS 304 is non-magnetic austenitic stainless steel, but may have magnetism when drawn into fibers or foil. In addition to SUS 304, the brush member 67D may include fibers including a magnetic ferrite material and/or fibers including nickel.

A recording medium feed test performed with the transfer-fixing device 66B revealed that the brush member 67D followed and contacted a recording medium P without being curled or bent even when the recording medium P had great surface asperities up to about 23 seconds of smoothness like Sabre-X80, providing a stable fixing performance. Smoothness represents surface asperities of a recording medium P and is expressed in seconds according to the pulp and paper test method No. 5-74 of Japan Technical Association of the Pulp and Paper industry. The greater the smoothness is, the smaller the surface asperities become. In Japan, plain paper having a smoothness of about 30 seconds or more is used in image forming apparatuses using an electrophotographic method. High-quality paper has a smoothness exceeding about 100 seconds. Paper having a smoothness of less than about 30 seconds is hardly used in Japan, but certain types of paper available in countries other than Japan and special paper used for a cover of a booklet have a smoothness of less than about 30 seconds.

As illustrated in FIG. 5, according to this example embodiment, like the transfer-fixing device 66 (depicted in FIG. 2) and the transfer-fixing device 66A (depicted in FIG. 4), the transfer-fixing device 66B includes the heating device 67Y effectively heating a transfer-fixing surface of a recording medium P before the recording medium P is conveyed to the nip formed between the transfer-fixing belt 27 and the pressing roller 68. The transfer-fixing device 66B further includes the equalization roller 85 for equalizing temperature distribution on the transfer-fixing belt 27 in the width direction of the transfer-fixing belt 27 after the transfer-fixing process. Thus, the transfer-fixing device 66B may reduce energy consumption and may reduce or prevent formation of a faulty image caused by improper fixing.

According to this example embodiment, the brush member 67D is used as a heat transmission member. Thus, the heating device 67Y may properly and uniformly heat the transfer-fixing surface of the recording medium P having great surface asperities and thereby having a small smoothness.

Figure 6:
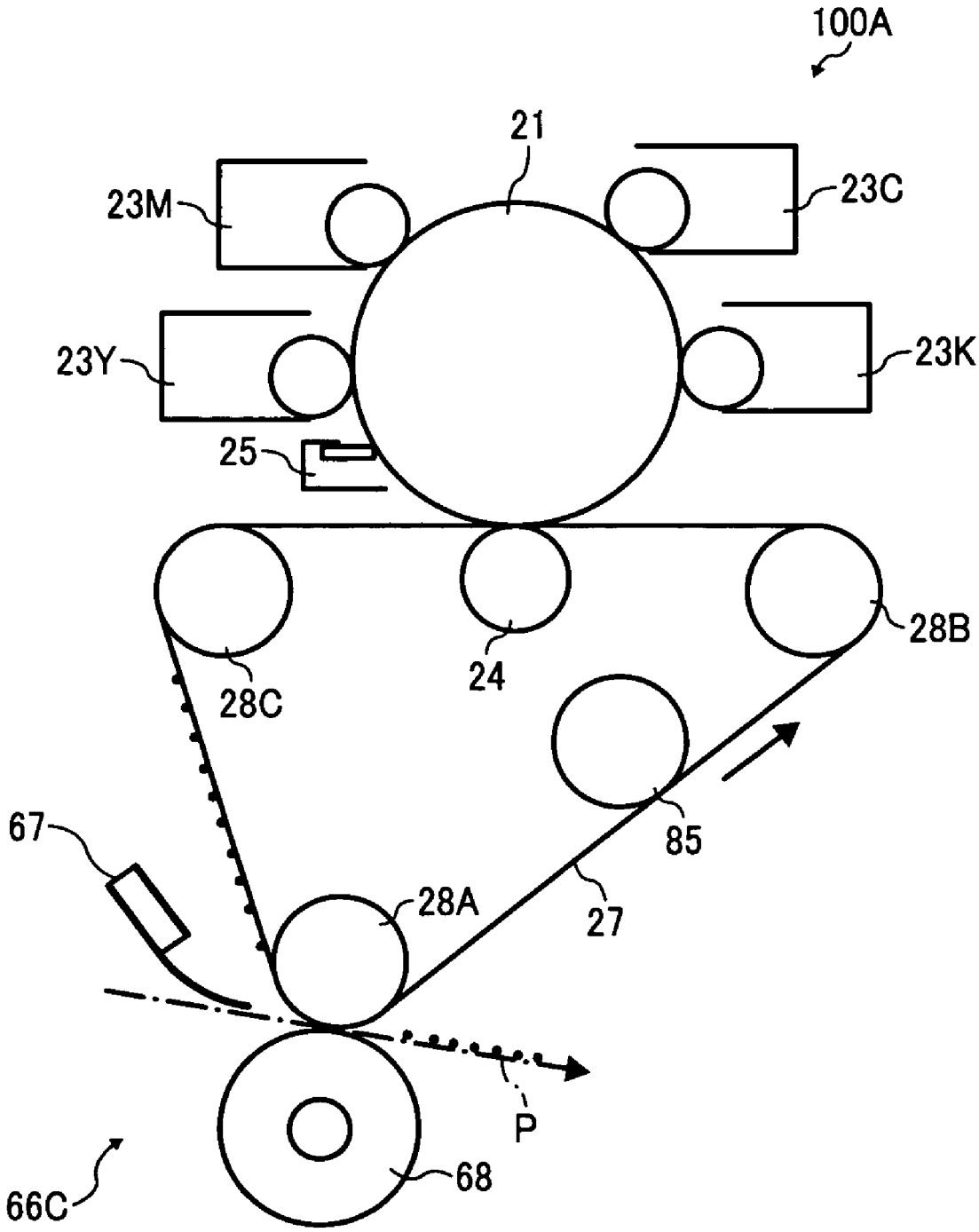
FIG. 6 is a partial sectional view of an image forming apparatus according to yet another example embodiment.

Referring to FIG. 6, the following describes an image forming apparatus 100A according to yet another example embodiment. FIG. 6 is a partial sectional view of the image forming apparatus 100A. The image forming apparatus 100A includes a photoconductor 21, the development devices 23Y, 23M, 23C, and 23K, a cleaner 25, and/or a transfer-fixing device 66C. The transfer-fixing device 66C includes a transfer bias roller 24, the rollers 28A, 28B, and 28C, the transfer-fixing belt 27, the equalization roller 85, the heating device 67, and/or the pressing roller 68. The other elements of the image forming apparatus 100A are common to the image forming apparatus 100 depicted in FIG. 1.

The image forming apparatus 100 includes the four photoconductors 21Y, 21M, 21C, and 21K. However, the image forming apparatus 100A includes one photoconductor 21. A charger (not shown), a writer (not shown), the development devices 23Y, 23M, 23C, and 23K, and the cleaner 25 are disposed around the photoconductor 21.

The charger charges a surface of the photoconductor 21 having a drum shape. The writer emits light beams corresponding yellow, magenta, cyan, and black image data toward the charged surface of the photoconductor 21 to form electrostatic latent images. The development devices 23Y, 23M, 23C, and 23K develop the electrostatic latent images with yellow, magenta, cyan, and black toners to form yellow, magenta, cyan, and black toner images. The yellow, magenta, cyan, and black toner images are superimposed on the photoconductor 21 to form a color toner image. The color toner image is transferred from the photoconductor 21 onto the transfer-fixing belt 27 at a position at which the transfer bias roller 24 opposes the photoconductor 21 via the transfer-fixing belt 27. The cleaner 25 cleans the surface of the photoconductor 21 after the color toner image is transferred to the transfer-fixing belt 27.

Like in the transfer-fixing device 66 (depicted in FIG. 2), 66A (depicted in FIG. 4), and 66B (depicted in FIG. 5), the color toner image carried by the transfer-fixing belt 27 is transferred and fixed onto a recording medium P heated by the heating device 67 at a nip formed between the pressing roller 68 and the transfer-fixing belt 27.

As illustrated in FIG. 6, according to this example embodiment, like the transfer-fixing device 66 (depicted in FIG. 2), 66A (depicted in FIG. 4), and 66B (depicted in FIG. 5), the transfer-fixing device 66C includes the heating device 67 effectively heating a transfer-fixing surface of a recording medium P before the recording medium P is conveyed to the nip formed between the transfer-fixing belt 27 and the pressing roller 68. The transfer-fixing device 66C further includes the equalization roller 85 for equalizing temperature distribution on the transfer-fixing belt 27 in the width direction of the transfer-fixing belt 27 (e.g., a direction perpendicular to a conveyance direction of the recording medium P) after the transfer-fixing process. Thus, the transfer-fixing device 66C may reduce energy consumption and may reduce or prevent formation of a faulty image caused by improper fixing.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A transfer-fixing device for transferring and fixing a toner image onto a transfer-fixing surface of a recording medium, the transfer-fixing device comprising:

a transfer-fixing member to carry the toner image;

a pressing member to pressingly contact the transfer-fixing member to form a nip between the pressing member and the transfer-fixing member through which the recording medium passes;

a heating member to heat the transfer-fixing surface of the recording medium conveyed toward the nip so that the recording medium reaches the nip before a temperature of a back surface of the recording medium opposite the transfer-fixing surface of the recording medium increases, the heating member including a brush member configured to contact the transfer-fixing surface of the recording medium; and a temperature equalization member to equalize temperature distribution on a surface of the transfer-fixing member in a width direction of the transfer-fixing member perpendicular to a conveyance direction of the recording medium, after the surface of the transfer-fixing member passes the nip.

2. The transfer-fixing device according to claim 1, wherein the recording medium has a thickness not less than about 50 μm, and reaches the nip within about 50 milliseconds after the recording medium passes the heating member.

3. The transfer-fixing device according to claim 1, wherein the heating member includes a heating body having a Curie point lower than an ignition point of the recording medium.

4. The transfer-fixing device according to claim 3, wherein the heating body includes a resistance heat generator of which resistance increases at the Curie point.

5. The transfer-fixing device according to claim 3, wherein the heating body generates heat by electromagnetic induction and includes a metal of which magnetic permeability decreases at the Curie point.

6. The transfer-fixing device according to claim 1, wherein the heating member includes a plurality of heating bodies arranged in a width direction perpendicular to the conveyance direction of the recording medium, the plurality of heating bodies controlled to heat an image area on the transfer-fixing surface of the recording medium.

7. The transfer-fixing device according to claim 1, further comprising:

a magnetic force generator to generate a magnetic force, wherein the brush member is a magnetic brush member configured to contact the transfer-fixing surface of the recording medium by the magnetic force generated by the magnetic force generator so as to transmit heat to the transfer-fixing surface of the recording medium.

8. The transfer-fixing device according to claim 1, wherein the temperature equalization member comprises a heat pipe.

9. The transfer-fixing device according to claim 1, further comprising:

a plurality of rollers to support the transfer-fixing member, wherein the transfer-fixing member is belt-shaped and looped over the plurality of rollers.

10. The transfer-fixing device according to claim 9, wherein the temperature equalization member forms one of the plurality of rollers.

11. The transfer-fixing device according to claim 1, wherein the heating member further includes a heating body and an electrode.

12. The transfer-fixing device according to claim 11, wherein the heating body is disposed between the brush member and the electrode.

13. The transfer-fixing device according to claim 1, wherein the brush member is magnetic and contacts the transfer-fixing surface of the recording medium to transmit heat to the recording medium.

14. The transfer-fixing device according to claim 13, wherein the brush member acts as a heat transmission member.

15. The transfer-fixing device according to claim 1, further comprising a magnet, serving as a magnetic force generator, provided inside of the pressing member and opposes the brush member.

16. The transfer-fixing device according to claim 15, wherein the magnet generates a magnetic force for attracting the brush member to the recording medium so as to prevent bristles of the brush member from curling or bending.

17. The transfer-fixing device according to claim 16, wherein the bristles are bundle of fibers formed of SUS 304 and have an outer diameter of about 40 μm.

18. An image forming apparatus, comprising:

a transfer-fixing device to transfer and fix a toner image onto a transfer-fixing surface of a recording medium, the transfer-fixing device comprising:

a transfer-fixing member to carry the toner image;

a pressing member to pressingly contact the transfer-fixing member to form a nip between the pressing member and the transfer-fixing member through which the recording medium passes;

a heating member to heat the transfer-fixing surface of the recording medium conveyed toward the nip so that the recording medium reaches the nip before a temperature of a back surface of the recording medium opposite the transfer-fixing surface of the recording medium increases, the heating member including a brush member configured to contact the transfer-fixing surface of the recording medium; and a temperature equalization member to equalize temperature distribution on a surface of the transfer-fixing member in a width direction of the transfer-fixing member perpendicular to a conveyance direction of the recording medium, after the surface of the transfer-fixing member passes the nip.

19. A transfer-fixing method, comprising:

carrying a toner image with a transfer-fixing member;

forming a nip between the transfer-fixing member and a pressing member;

heating a transfer-fixing surface of a recording medium conveyed toward the nip so that the recording medium reaches the nip before a temperature of a back surface of the recording medium opposite the transfer-fixing surface of the recording medium increases;

transferring and fixing the toner image carried by the transfer-fixing member onto the heated recording medium at the nip; and equalizing temperature distribution on a surface of the transfer-fixing member in a width direction of the transfer-fixing member perpendicular to a conveyance direction of the recording medium, after the surface of the transfer-fixing member passes the nip, wherein heating of the transfer-fixing surface of the recording medium is performed by a brush member configured to contact the transfer-fixing surface of the recording medium.

* * * * *